US008428481B2

(12) United States Patent
Thayer et al.

(10) Patent No.: US 8,428,481 B2
(45) Date of Patent: Apr. 23, 2013

(54) LONG LIFE CLEANING SYSTEM WITH REDUCED STRESS FOR START OF CLEANING BLADE OPERATION

(75) Inventors: Bruce Earl Thayer, Spencerport, NY (US); Aaron Michael Burry, Ontario, NY (US); William C. Dean, Webster, NY (US)

(73) Assignee: Xerox Corporation

( * ) Notice: Subject to any disclaimer, the term of this patent is extended or adjusted under 35 U.S.C. 154(b) by 269 days.

(21) Appl. No.: 12/840,729

(22) Filed: Jul. 21, 2010

(65) Prior Publication Data

US 2012/0020692 A1 Jan. 26, 2012

(51) Int. Cl.
*G03G 15/00* (2006.01)

(52) U.S. Cl.
USPC ..... 399/71; 399/123; 399/343; 399/345; 399/346; 399/350; 399/351

(58) Field of Classification Search ..... 399/71, 399/123, 343, 345, 346, 350, 351
See application file for complete search history.

(56) References Cited

U.S. PATENT DOCUMENTS 3,660,863 A 5/1972 Gerbasi
4,469,434 A 9/1984 Yamazaki et al.
5,319,431 A 6/1994 Lindblad et al.
5,386,282 A * 1/1995 Palmer et al. ..... 399/345
7,620,357 B2 11/2009 Shakuto et al.
2008/0023168 A1 1/2008 Conn et al.
2008/0025775 A1 1/2008 Hays et al.
2009/0103944 A1* 4/2009 Shintani et al. ..... 399/346
2009/0126135 A1 5/2009 Gilmore et al.

* cited by examiner

*Primary Examiner* — Ryan Walsh
(74) *Attorney, Agent, or Firm* — Ellis B. Ramirez; Richard A. Castellano; Ronald E. Prass, Jr.

(57) ABSTRACT

According to aspects of the embodiments, there is provided an apparatus and method to manage the contact of a cleaning blade and a moving surface to increase the useful life of the blade. For example, a cleaning apparatus for a photoreceptor surface comprises a cleaning unit with a blade holder that rotates about a pivot point, a cleaning blade that is coupled to the blade holder and is positioned to chisel excess toner from the photoreceptor surface, and which cleans excess toner from the photoreceptor surface. The apparatus further comprises a sensor that senses the start and the end of an operational procedure, and an actuator that rotates the blade holder about the pivot point to selectively advance or retract the blade during the start-up procedure and the shut-down procedure. After the cleaning surface has begun to move or reached operating speed, blade contact is increased to bring the blade load up to operational level. By making this change to the conventional static cleaning blade, the peak stress at start-up and shut-down is much reduced and cleaning blade life and reliability are much improved.

16 Claims, 8 Drawing Sheets

LONG LIFE CLEANING SYSTEM WITH REDUCED STRESS FOR START OF CLEANING BLADE OPERATION

BACKGROUND

This disclosure relates in general to copier/printers, and more particularly, to cleaning residual toner from an imaging device surface and reducing cleaning blade failure by controlling blade stress incurred during the start and stop of operation cycles.

In a typical electrophotographic printing process, a photoreceptor or photoconductive member is charged to a uniform potential to sensitize the surface thereof. The charged portion of the photoconductive member is exposed to a light image of an original document being reproduced. Exposure of the charged photoconductive member selectively dissipates the charges thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. Toner particles attracted from the carrier granules to the latent image form a toner powder image on the photoconductive member. The toner powder image is then transferred from the photoconductive member to a copy sheet. Heating of the toner particles permanently affixes the powder image to the copy sheet. After each transfer process, the toner remaining on the photoconductor is cleaned by a cleaning device.

Blade cleaning is a technique for removing toner and debris from a photoreceptor, photoconductive member, or other substrate surface within a printing system. In a typical application, a relatively thin elastomeric blade member is supported adjacent to and transversely across the photoreceptor with a blade edge that chisels or wipes toner from the surface. Toner accumulating adjacent to the blade is transported away from the blade area by a toner transport arrangement or by gravity. Blade cleaning is advantageous over other cleaning systems due to its low cost, small cleaner unit size, low power requirements, and simplicity. However, cleaning blades are primarily used in a static mode. The blade is either interference loaded or force loaded and remains in the operating position throughout the start-operate-stop cycle ("operating cycle") of completing printing jobs. The static mode shortens the life of cleaning blades due to failures brought about from interaction with the photoreceptor chiefly at the beginning and ending of the operating cycle. Photoreceptor surface coatings while improving photoreceptor life typically results in far higher blade wear rates due to friction. Frictional forces cause the blade edge to stick and slip or chatter as it rubs against the photoreceptor surface. As the blade rubs over the photoreceptor, the blade sticks to the photoreceptor because of static frictional forces. This stick-slip interaction or chatter is a significant cause of blade failure and can therefore be very disruptive of the printing process. A lubrication film or lubricating particles between the rubbing surfaces reduces the intensity of the stick-slip (chatter) generated by the relative motion, but adverse interactions with other electrophotographic systems may occur.

Cleaning blades are typically designed to operate at either a fixed interference or fixed blade load as disclosed in U.S. Pat. No. 5,208,639 which is included herein by reference. Because of blade relaxation and blade edge wear over time, part and assembly tolerance, and cleaning stresses from environmental conditions and toner input, the cleaning blade is initially loaded to a blade load high enough to provide good cleaning at extreme stress conditions for all of the blade's life. However, a higher than required blade load causes the blade and charge retentive surface to wear more quickly. Overcoated charge retentive surfaces have been developed to reduce the wear rate. While an overcoat protects the charge retentive surface, the overcoats increase the wear rate of the blades.

For the reasons stated above, and for other reasons stated below which will become apparent to those skilled in the art upon reading and understanding the present specification there is need in the art for systems, apparatus, and/or methods that increase the reliability of cleaning blades.

SUMMARY

According to aspects of the embodiments, there is provided an apparatus and method to manage the contact of a cleaning blade and a surface to increase the useful life of the blade. For example, a cleaning apparatus for a moving photoreceptor surface comprises a cleaning unit with a blade holder that rotates about a pivot point, a cleaning blade that is coupled to the blade holder and is positioned to remove excess toner from the photoreceptor surface, and which cleans excess toner from the photoreceptor surface. The apparatus further comprises a sensor that senses the start and the end of an operational procedure, and an actuator that rotates the blade holder about the pivot point to selectively advance or retract the blade during the start-up procedure and the shut-down procedure. After the cleaning surface has begun to move or reached operating speed, blade contact is increased to bring the blade load up to operational level. By making this change to the conventional static cleaning blade, the peak stress at start-up and shut-down is much reduced and cleaning blade life and reliability are much improved.

DETAILED DESCRIPTION

Figure 1:
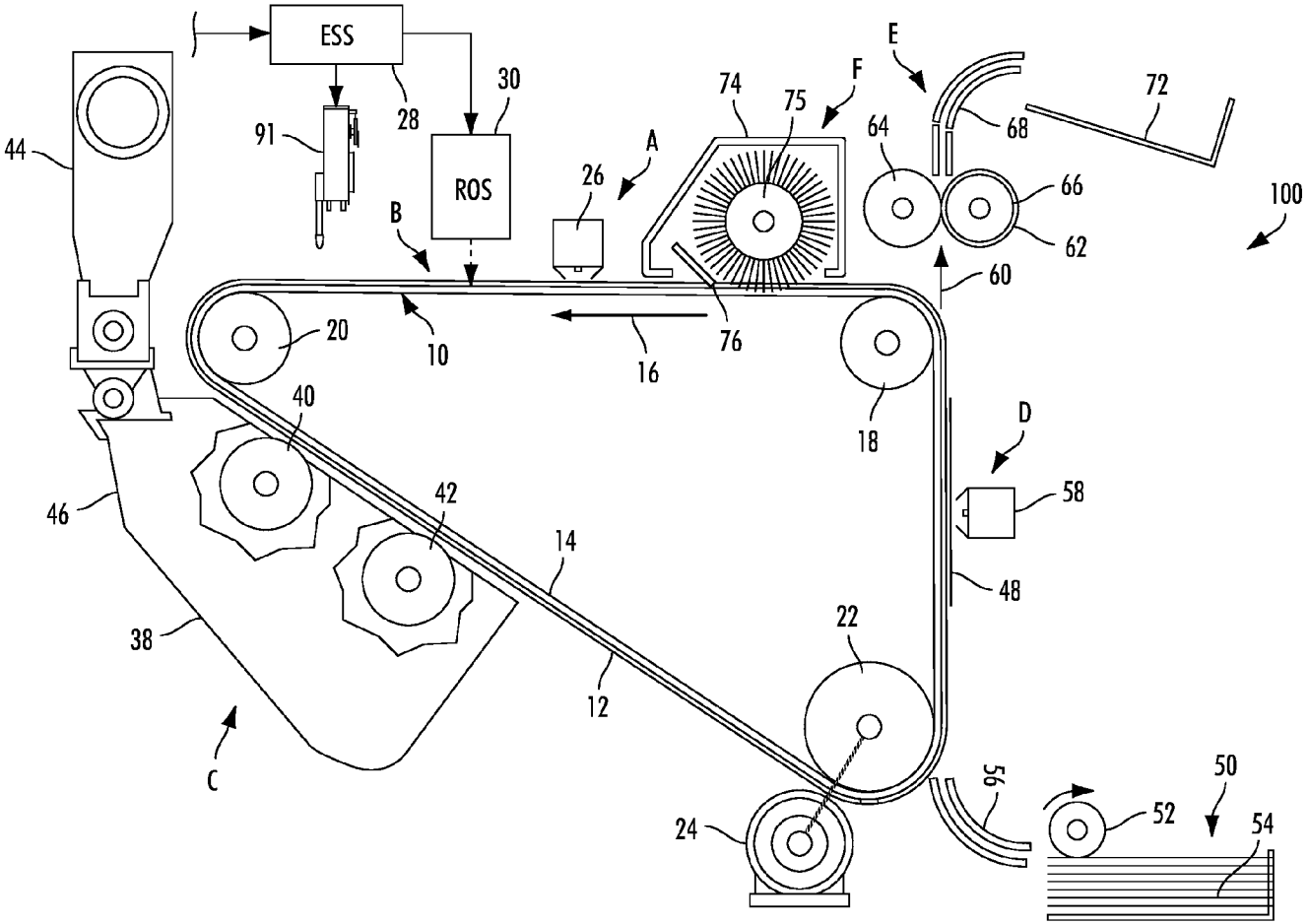
FIG. 1 is a schematic elevational view of an electrophotographic printing machine including a cleaning system with reduced stress during start-up and shut-down in accordance to an embodiment.

In accordance with various aspects described herein, systems and methods are described that facilitate cleaning a photoreceptor surface in a xerographic imaging device using cleaning blades. In order to greatly reduce blade stress incurred during the start and stop of operation cycles the disclosed invention reduces blade load or moves the blade entirely out of contact with the cleaning surface prior to putting the cleaning surface into motion. By reducing blade load when the cleaning surface is traveling below the operating speed, high blade stresses are avoided and blade life and reliability are improved. The apparatus further comprises a sensor that senses operating cycle, and an actuator that rotates the blade holder about the pivot point to position the blade adjacent to the photoreceptor surface upon detection of a change in cycle condition.

Aspects of the disclosed embodiments relate to an image forming machine comprising a moving surface; a blade having a blade tip; a blade positioning mechanism connected to the blade to move the blade into a position wherein the blade tip engages the moving surface creating a blade load on the moving surface, wherein the blade load is at least one of a low blade load, an operating speed blade load, and a standby blade load; a sensor to detect an operating cycle for the image forming machine, wherein the operating cycle comprises at least a start-up procedure and a shut-down procedure; and a controller to cause the blade positioning mechanism to advance or retract the blade based on the detected operating cycle; wherein blade wear produced from blade and moving surface contact is reduced by selectively advancing or retracting the blade during the start-up procedure and the shut-down procedure.

In yet another aspect the disclosed embodiments include an image forming machine wherein the moving surface is at least one of drum rotating in an operational direction, a flat surface moving in an operational direction, or a belt moving in an operational direction.

In still another aspect the disclosed embodiments include an image forming machine wherein the blade positioning mechanism comprises a supporting member having a rotational axis and being configured to hold the blade.

Still other aspects of the disclosed embodiments include an image forming machine further comprising a lubricant unit to place, based on the detected start-up procedure, at least one lubrication stripe of lubricating material on a portion of the moving surface.

In yet another aspect the disclosed embodiments include an image forming machine wherein to advance the blade is to move the blade into a position wherein the blade tip engages the moving surface at less than operating speed creating a low blade load.

Further aspects of the disclosed embodiments include an image forming machine wherein to retract the blade comprises moving the blade into a position wherein the blade tip engages the moving surface at less than operating speed creating a low blade load.

Still further aspects of the disclosed embodiments include an image forming machine wherein to advance the blade is to move the blade into a position wherein the blade tip engages the moving surface at operating speed creating an operating speed blade load.

In yet another aspect the disclosed embodiments include a method to increase the life of a blade for cleaning a moving surface by performing the steps of detecting a predetermined operating cycle for the moving surface; increasing blade interaction with the moving surface after a start of the operating cycle, wherein the blade interaction is selected from a group consisting of a low blade load or an operating speed blade load; decreasing the blade interaction with the moving surface during a shut-down of the operating cycle, wherein the blade interaction is selected from a group consisting of a low blade load or a standby blade load; wherein wear produced from blade and moving surface contact is reduced by selectively increasing and decreasing blade interaction with the moving surface at the start and shut-down of the operating cycle.

Still further another disclosed embodiment includes a blade engagement apparatus to increase the life of a blade associated with an image forming machine having an associated moving surface comprising a blade having a blade tip; a blade positioning mechanism connected to the blade to move the blade into a position wherein the blade tip engages the moving surface creating a blade load on the moving surface; an actuator connected to the blade positioning mechanism; a sensor coupled to the moving surface, wherein movement of the moving surface causes the sensor to generate signals; and a logic circuit to selectively adjust the position of the blade based on the generated sensor signals by: determining from the generated signals an operating cycle start, an operating cycle operational speed, and an operating cycle shut-down procedure; and signaling the actuator to actuate the blade positioning mechanism to adjust the blade load for each operating cycle, wherein the blade load is at least one of a low blade load, an operating speed blade load, and a standby blade load.

Embodiments as disclosed herein may also include computer-readable media for carrying or having computer-executable instructions or data structures stored thereon for operating such devices as controllers, sensors, and electromechanical devices. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

The term "print media" generally refers to a usually flexible, sometimes curled, physical sheet of paper, plastic, or other suitable physical print media substrate for images, whether precut or web fed.

The term "image forming machine" as used herein refers to a digital copier or printer, electrographic printer, bookmaking machine, facsimile machine, multi-function machine, or the like and can include several marking engines, as well as other print media processing units, such as paper feeders, finishers, and the like. The term "electrophotographic printing machine," is intended to encompass image reproduction machines, electrophotographic printers and copiers that employ dry toner developed on an electrophotographic receiver element.

FIG. 1 schematically illustrates an electrophotographic printing machine 100, such as a digital copier, which generally employs a photoreceptor 10, such as a drum or belt, having a photoconductive surface 12 deposited on a conductive ground layer 14. Preferably, photoconductive surface 12 is made from a photoresponsive material, for example, one comprising a charge generation layer and a transport layer. Photoreceptor 10 moves in the direction of arrow 16 to advance successive portions of the photoreceptor sequentially through the various processing stations disposed about the path of movement thereof.

Photoreceptor 10, shown in the form of a belt, may be entrained about stripping roller 18, tensioning roller 20, and drive roller 22. Drive roller 22 is driven by motor 24 to advance photoreceptor 10 in the direction of arrow 16. Photoreceptor 10 may be maintained in tension by a pair of springs (not shown) resiliently urging tensioning roller 20 against photoreceptor 10 with a desired spring force. Stripping roller 18 and tensioning roller 20 may be mounted to rotate freely.

Initially, a portion of photoreceptor 10 passes through charging station A. At charging station A, a corona generating device, indicated generally by the reference numeral 26 charges the photoconductive surface 12 to a relatively high, substantially uniform potential. After photoconductive surface 12 of photoreceptor 10 is charged, the charged portion thereof is advanced through exposure station B.

At an exposure station, B, a controller or electronic subsystem (ESS), indicated generally by reference numeral 28, receives the image signals representing the desired output image and processes these signals to convert them to a continuous tone or grayscale rendition of the image, which is transmitted to a modulated output generator, for example the raster output scanner (ROS), indicated generally by reference numeral 30. The image signals transmitted to ESS 28 may originate from a computer, thereby enabling the electrophotographic printing machine to serve as a remotely located printer for one or more computers. Alternatively, the printer may serve as a dedicated printer for a high-speed computer.

The signals from ESS 28, corresponding to an image desired to be reproduced by the printing machine, are transmitted to ROS 30. ROS 30 includes a laser with rotating polygon mirror blocks. The ROS illuminates the charged portion of photoconductive belt 10 at a suitable resolution. The ROS exposes the photoconductive belt to record an electrostatic latent image thereon corresponding to the image received from ESS 28. As an alternative, ROS 30 may employ a linear array of light emitting diodes (LEDs) arranged to illuminate the charged portion of photoconductive belt 10 on a raster-by-raster basis.

ESS 28 may be connected to a raster input scanner (RIS). The RIS may have document illumination lamps, optics, a scanning drive, and photosensing elements, such as an array of charge coupled devices (CCD) to capture an entire image from an original document and convert it to a series of raster scan lines that are transmitted as electrical signals to ESS 28. ESS 28 processes the signals received from the RIS and converts them to grayscale image intensity signals that are then transmitted to ROS 30. ROS 30 exposes the charged portion of the photoconductive belt to record an electrostatic latent image thereon corresponding to the grayscale image signals received from ESS 28.

After the electrostatic latent image has been recorded on photoconductive surface 12, photoreceptor 10 advances the latent image to a development station, C, where toner is electrostatically attracted to the latent image. As shown, at development station C, a magnetic brush development system, indicated by reference numeral 38, advances developer material into contact with the latent image. Magnetic brush development system 38 includes at least one magnetic brush developer, such as rollers 40 and 42 shown. Rollers 40 and 42 advance developer material into contact with the latent image. These developer rollers form a brush of carrier granules and toner particles extending outwardly from the brush. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38. In the illustrated embodiment, the toner placed by the development system 38, in combination with a special latent image created on the photoreceptor 10 by the exposure ROS 30, serves as the lubricant, and thus the development system and exposure system can together be considered a lubricant unit in accordance to an embodiment. In other possible embodiments, a separate device 91 such as an auger disposed along the path of the photoreceptor can provide lubricant in small amounts as needed. ESS 28 is configured to control the separate device 91 so as to apply the lubricant to the image bearing member at a predetermined time. Suitable lubricant material may be made of a solid, liquid, powdery or similar lubricant material. The solid lubricant may be made from zinc stearate or similar fatty acid metal salt, polyolefin resin, silicone grease, fluorine grease, paraffin wax, graphite, or molybdenum disulfide. A liquid lubricant may be silicone oil, fluorine oil, or the like. A powdery lubricant may be the powder of the above solid lubricant. The liquid, solid or powdery lubricant may be used alone or in combination.

With continued reference to FIG. 1, after the electrostatic latent image is developed, the toner powder image present on photoreceptor 10 advances to transfer station D. A print media 48 is advanced to the transfer station, D, by a media feeding apparatus, 50. Media feeding apparatus 50 may include a feed roll 52 contacting the uppermost media of stack 54. Feed roll 52 rotates to advance the uppermost media from stack 54 into chute 56. Chute 56 directs the advancing media of support material into contact with photoconductive surface 12 of belt 10 in a timed sequence so that the toner powder image formed thereon contacts the advancing media at transfer station D. Transfer station D may include a corona generating device 58 that sprays ions onto the back side of media 48. This attracts the toner powder image from photoconductive surface 12 to media 48. After transfer, media 48 continues to move in the direction of arrow 60 onto a conveyor (not shown), which advances media 48 to fusing station E.

Fusing station E includes a fuser assembly, indicated generally by the reference numeral 62, which permanently affixes the transferred powder image to media 48. Fuser assembly 62 includes a heated fuser roller 64 and a back-up roller 66. Media 48 passes between fuser roller 64 and back-up roller 66 with the toner powder image contacting fuser roller 64. In this manner, the toner powder image is permanently affixed to media 48. After fusing, media 48 advances through chute 68 to catch tray 72 for subsequent removal from the printing machine by the operator.

After the print media is separated from photoconductive surface 12 of belt 10, the residual toner/developer and any paper fiber particles adhering to photoconductive surface 12 are cleaned at cleaning station F. Cleaning station F will include a housing 74 and may contain a rotatably mounted fibrous brush 75 in contact with photoconductive surface 12 to disturb and remove paper fibers and cleaning blade 76 to remove the non-transferred toner particles. The cleaning blade 76 may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
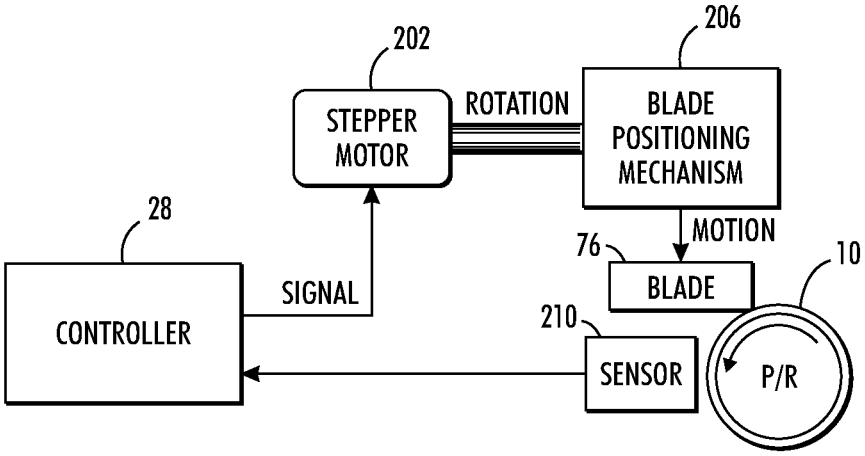
FIG. 2 is a schematic of a single stepper motor system used in the cleaning system of FIG. 1 to control blade load in accordance to an embodiment.

FIG. 2 is a schematic of a single stepper motor system used in the cleaning system of FIG. 1 to control blade load 200 in accordance to an embodiment. Rotation of blade holder 76 through blade positioning mechanism 206, which could be a shaft, two independently driven positioning links, a four bar linkage, cams, guide slots, or other conventional mechanism, controls the amount of interference for the blade in the assembly. By controlling the amount of rotation, the blade load can be varied. The blade holder pivots about a pivot point to position the blade 76 against a moving surface such as a drum rotating in an operational direction, a flat surface moving in an operational direction, or a photoreceptor belt 10 moving in an operational direction, which has a direction of rotation indicated by the arrow at the bottom of photoreceptor belt 10. A stepper motor 202 is used to provide rotation of blade holder 76 in defined increments. A sensor 210 is positioned after cleaner unit (not shown) to provide a detection system that detects the operating cycle for the moving surface. The detection system or the sensor to detect an operating cycle can include a program module or routine that through various timing signals can ascertain when the machine or printer is going to be cycled up or down. This information can then be communicated to the controller that operates the blade load mechanism. The operating cycle can be sub-divided into three distinct regions namely as the start-operate-stop cycle of completing printing jobs. The output from the sensor is input to a controller 28. Controller 28 sends a signal to stepper motor 202 to increase blade interference until a signal sensor 210 indicates a change in the operating cycle. To optimize cleaning blade life, the blade load must be varied at the minimum load for cleaning and to reduce stress experienced at the start and ending of the operating cycle. This will result in the lowest possible wear on the cleaning blade and the photoreceptor while still maintaining good cleaning.

Figure 3:
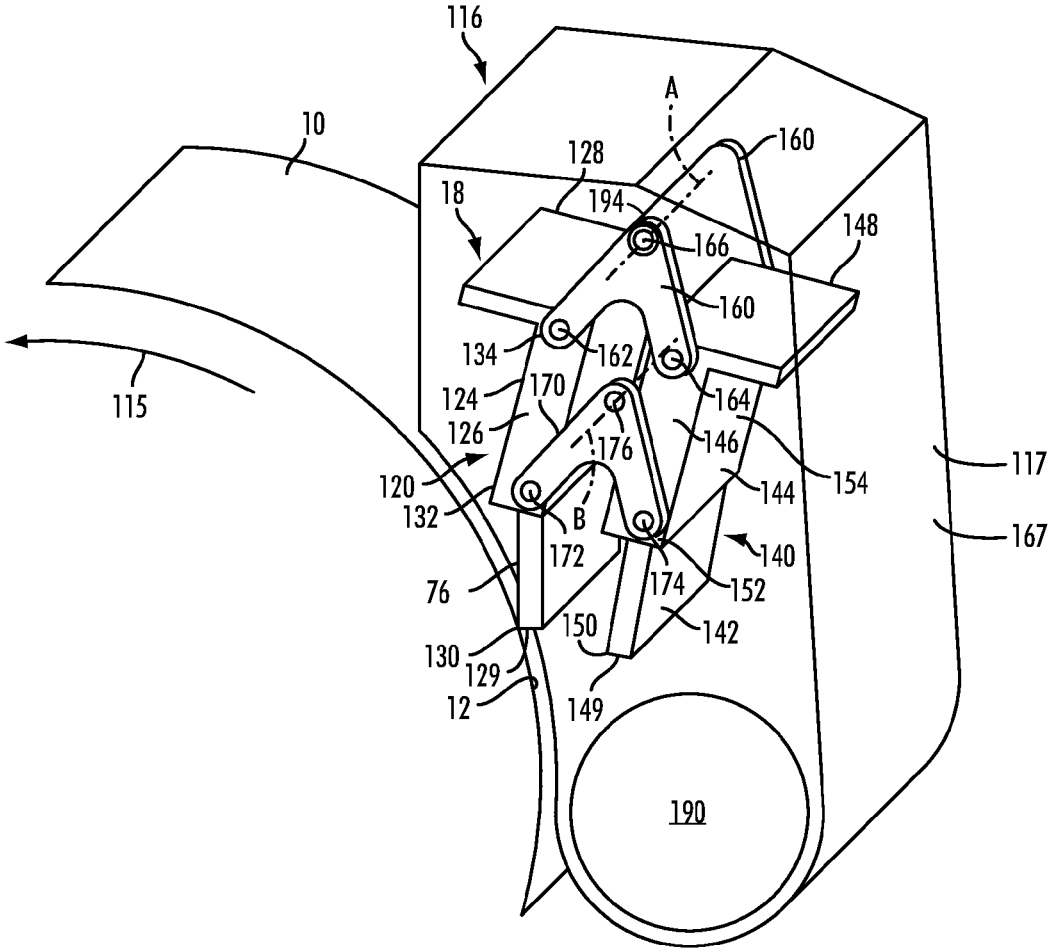
FIG. 3 is a perspective view illustrating an alternative blade cleaning system with link mechanism to create a blade load on the moving surface in accordance to an embodiment.

FIG. 3 is a perspective view illustrating an alternative blade cleaning system with link mechanism to create a blade load on the moving surface in accordance to an embodiment. The electrophotographic printing machine 100 includes a cleaning system, shown generally at 116, for cleaning toner particles, residue and other materials from a moving surface such as photoreceptor surface 12 or cleaning surface and the like. Though some examples provided describe a system for cleaning moving photoreceptor belt 10, the system 116 can also clean other image forming device moving surfaces, including but not limited to moving transfer surfaces such as biased transfer belts, biased transfer rolls, or intermediate transfer belts. Each of these moving surfaces can be equipped with their own indicia or could be monitored to determine the start-operate-stop cycle of completing its unique function. Regardless of the surface, reducing blade load when motion is below the operating speed lowers high blade stresses resulting higher blade life and reliability.

The cleaning system 116 can be contained in a removable cartridge housing 117, if so desired, such as for example part of a print cartridge, also referred to a Xerographic Replaceable Unit (XRU). The XRU can be removed from the image forming device 110 and discarded when its useful life has been depleted.

The cleaning system 116 includes a first cleaning blade 120 having a blade 76 extending from a blade holder 124 and terminating in an end 129. The blade 76, when placed against the surface of the moving surface, removes excess waste toner which is directed toward a toner removal auger 190 that removes the waste toner from the cleaner unit 116. Waste toner may then be discarded, recycled, etc. The cleaning system 116 also includes a second cleaning blade 140 having a cleaning blade member 142 extending from a blade holder 144 and terminating in an end 149. The cleaning blade members can be formed of a compliant material, such as polyurethane, which enable the blade members to bend or deflect when moved into cleaning contact with the moving surface.

The cleaning system 116 includes a pair of first links 160 formed of a rigid material, such as metal, plastic, composites or the like. The first links 160 are connected to opposite lateral ends of the cleaning blades 76 and 140 to couple the cleaning blades together for moving one blade member into a cleaning position while simultaneously moving the other blade into a corresponding suspended position. The first links 160 are similar, and thus only one first link is shown in detail for the purposes of clarity. The first links 160 include first pivot connections 162 pivotally connected to the distal portions 134 of the oppositely disposed lateral ends 126 and 128 of the first blade holder 124. The first links 160 also include second pivot connections 164 pivotally connected to the distal portions 154 of the lateral ends 146 and 148 of the second blade holder 144. The first links 160 also include third pivot connections 166 pivotally connected to one or more frame members 167, enabling the first links to rotate about a fixed axis A while preventing non-pivoting displacement of the first links with respect to the frame. The frame 167 can be part of the cartridge 117, or a support member attached to an image forming device.

The cleaning system 116 also includes a pair of second links 170 formed of a rigid material, such as metal, plastic, composites or the like. The second links 170 are connected to opposite lateral ends of the cleaning blades 76 and 140 to also couple the cleaning blade members together. The second links 170 are similar, and thus only one second link is shown in detail for the purposes of clarity. The second links 170 include first pivot connections 172 pivotally connected to the proximate portions 132 of the oppositely disposed lateral ends 126 and 128 of the second blade holder 124. The second links 170 also include second pivot connections 174 pivotally connected to the proximate portions 152 of the lateral ends 146 and 148 of the second blade holder 144. The second links 170 also include third pivot connections 176 pivotally connected to one or more of the frame members 167, enabling the second links to rotate about a fixed axis B.

The first and second link pivot connections 162, 164, 166, 172, 174, and 176 can be formed by fasteners, such as rivets, bolts or the like extending from the blade holders 124, 144 or frame 167, and through apertures in the first and second links 160, 170, or in other manners which enable relative rotation at the connections. The pivot connections 162, 164 and 166 are disposed in a triangular arrangement on the first links 160, and the pivot connections 172, 174 and 176 are disposed in a triangular arrangement on the second links 170. The first and second links 160, 170 can be V-shaped, each having 2 legs extending from the third pivot connections 166, 176 with the first pivot connections 162, 172 and second pivot connections 164, 174 disposed at the ends thereof, as shown in FIG. 3. Such an arrangement can enable the links to be located close to each other without interfering in their movement. Other examples of the links 160, 170 can have triangular shapes with the pivot connections disposed at the vertices thereof. Other examples of the links can have other shapes.

An actuator 194 can be connected to one of the first links 160 to rotate it about the third pivot connection 166. The actuator 194 can be a solenoid, cam mechanism, or stepper motor, or some other actuator capable of rotating the first link 160 at connection 166. A cam mechanism usually consists of two moving elements, the cam and the follower, mounted on a fixed frame. Cam devices are versatile, and almost any arbitrarily-specified motion can be obtained. The actuator 194 can be disposed at the third pivot connection 166, or it can be disposed in another location and connected to the first link 160, such as by gears, arms, and the like so as to provide rotational movement to the first link 160. Other actuator arrangements capable of rotating the first and second links 160 and 170 about the third pivot connections, 166 and 176 respectively, are contemplated including, but not limited to using an actuator connected to one of the second links 170 to rotate it about the third pivot connection 176, or two actuators 194 connected to each of the first links 160 or two actuators 195 connected to each of the second links 170 for rotating them about the third pivot connections 166 and 176, respectively. The first or second link driven by the actuator 194, for rotation can be referred to as the drive link, whereas the undriven link can be referred to as the follower link.

Figure 4:
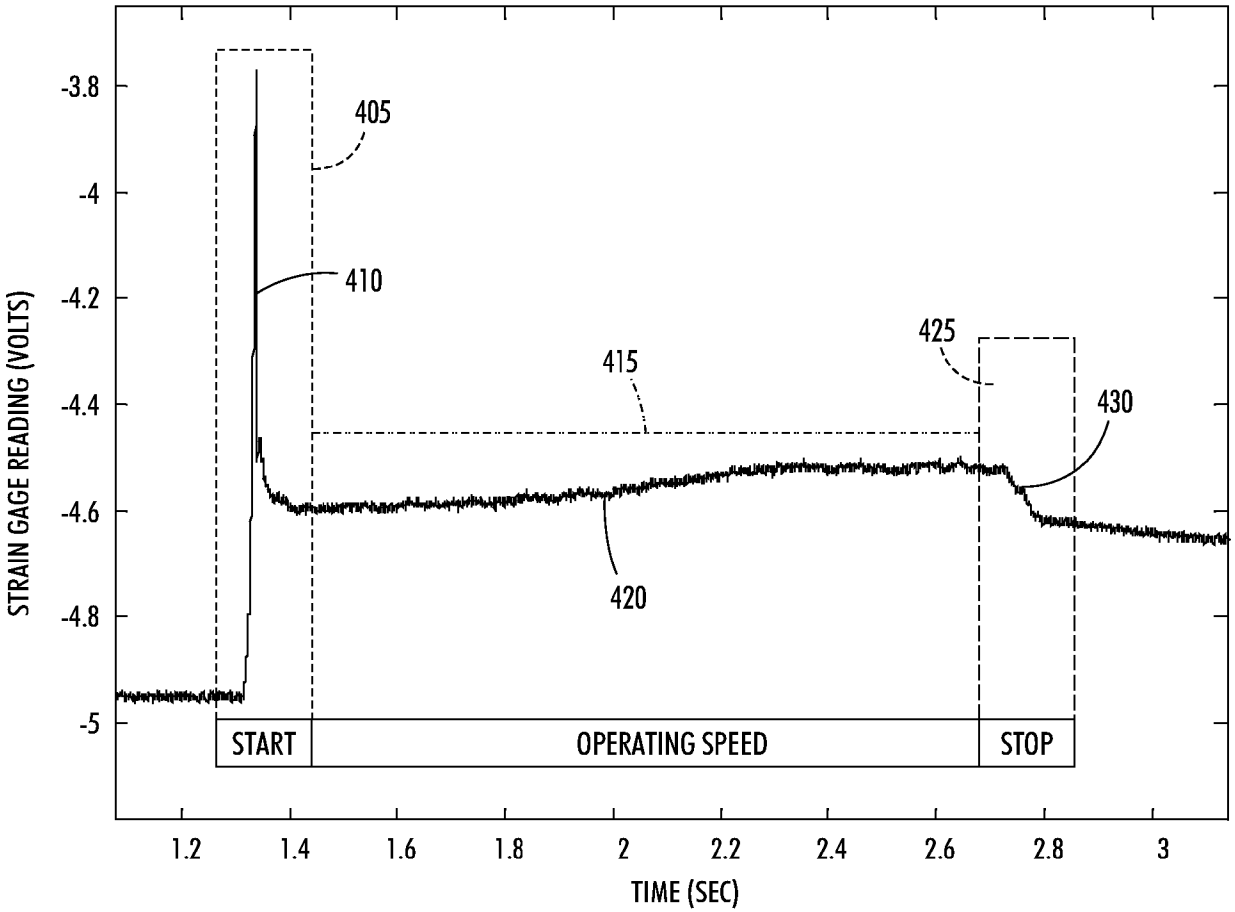
FIG. 4 is an illustration of blade tip strain during start-operate-stop cycle of operation in accordance to an embodiment.

FIG. 4 is an illustration of blade tip strain during start-operate-stop cycle of operation in accordance to an embodiment. The illustrated strain on the cleaning blade, such as blade 76, occurs in static mode cleaning. In static mode cleaning the blade is either interference loaded or force loaded and remains in the operating position throughout the start-operate-stop cycle. High blade stresses occur during the starting 405 and stopping 425 of the cleaning surface. The stress at the start of the operating cycle is shown as an upward spike level 410, a flat consistent stress level 420 is produced at the operate part of the operating cycle, and a downward sloping stress level 430 is produced at the stop part of the operating cycle.

Blade wear can be predicted by separating wear into a high wear rate ("HWR") when at slow cleaning surface speeds and a low wear rate ("LWR") at operating speed. HWR occurs during the start-up procedure and the shut-down procedure and is roughly 2.4381 $\mu m^2$/BLF kcycle for each occurrence. LWR occurs at the operating portion of the cycle and is roughly 0.0990 $\mu m^2$/BLF kcycle and is twenty five (25) times smaller than HWR. The HWR is multiplied by the number of start and stop occurrences and LWR is multiplied by the distance the blade travels on the cleaning surface. The sum of the start/stop wear (2*HWR) and the operating speed wear (LWR*Dist) predicts the measured wear of the blade in operation. The life and reliability of the blade can be much improved by reducing high start/stop wear (HWR) by increasing blade load from a low level up to the operating level.

Figure 5:
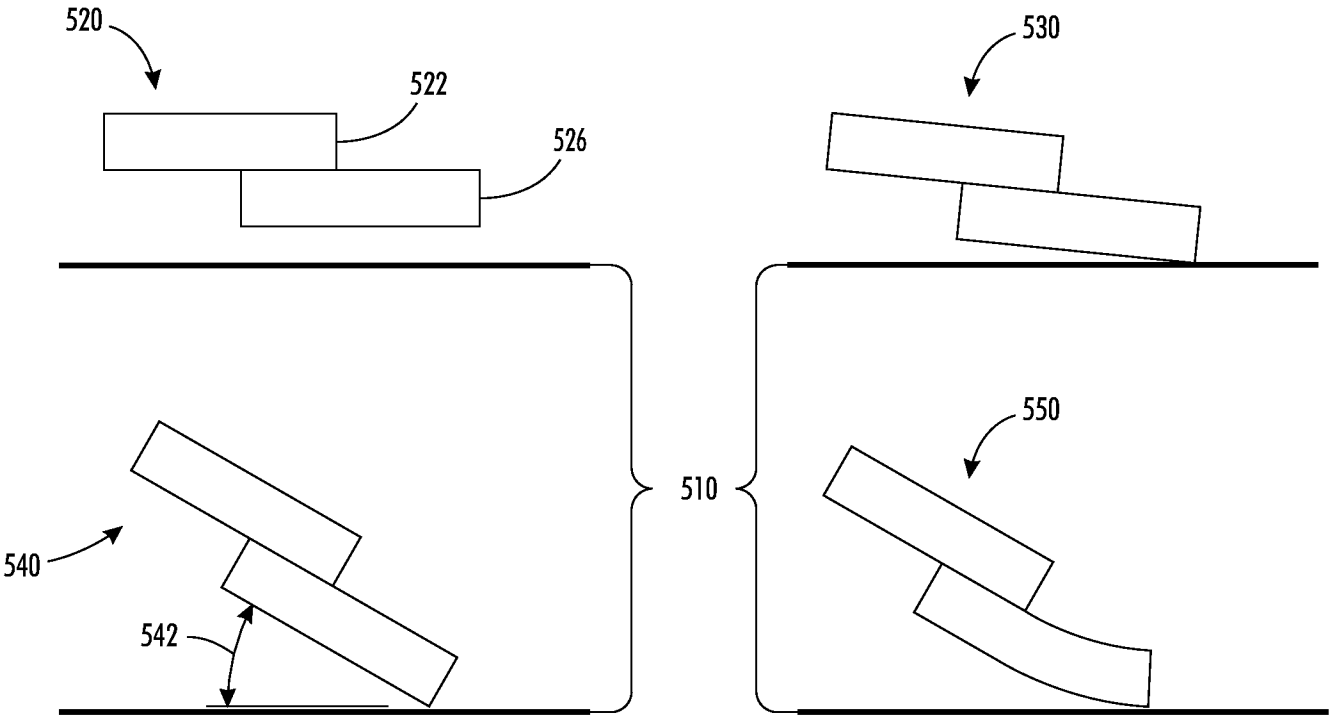
FIG. 5 is a schematic of blade interaction strategies for process start-up or for process shut-down in accordance to an embodiment.

FIG. 5 is a schematic of blade interaction strategies 500 for process start-up or for process shut-down in accordance to an embodiment. A blade positioning mechanism 522 holds the blade 526 so it can interact with a moving surface 510. The blade can be in a retracted position 520 from moving surface 510 placing the blade at a zero (0) angle and a zero load with the moving surface 510, placed at a low load and a low angle 530, at a low load and an increased angle 540, or at an operating load and operating angle 550 when the surface reaches an operating speed. Blade interaction strategy 520 is representative of a standby blade load, while 520 through 540 are representative of a low blade load strategy, and interaction strategy 550 is representative of an operating speed blade load. For process start-up blade contact proceeds from 520 or 530 to 550. For process shut-down blade contact proceeds from 550 to 520 or 530.

The operating load on blade 526 and the operating angle 542 of attack between the blade and the surface 510 are selected to apply sufficient pressure to shear agglomerations from the surface 510. The operating angle of attack is typically in the range of just greater than 0 degree to approximately 14 degrees with respect to surface 510. Additionally, the operating speed load on the blade is selected to be as low as possible for acceptable cleaning, in the range of 10 to 50 gm/cm. The selection of the particular operating angle 542 and operating speed load are affected by such matters as toner and surface types, toner additives, environmental and other operational conditions. The thickness and free extension of the blade from the blade holder as well as the durometer value of the material used for the blade and the friction coefficient between the blade and the surface determine the blade load and operating angle for a given amount of interference between the blade tip and the surface.

Figure 6:
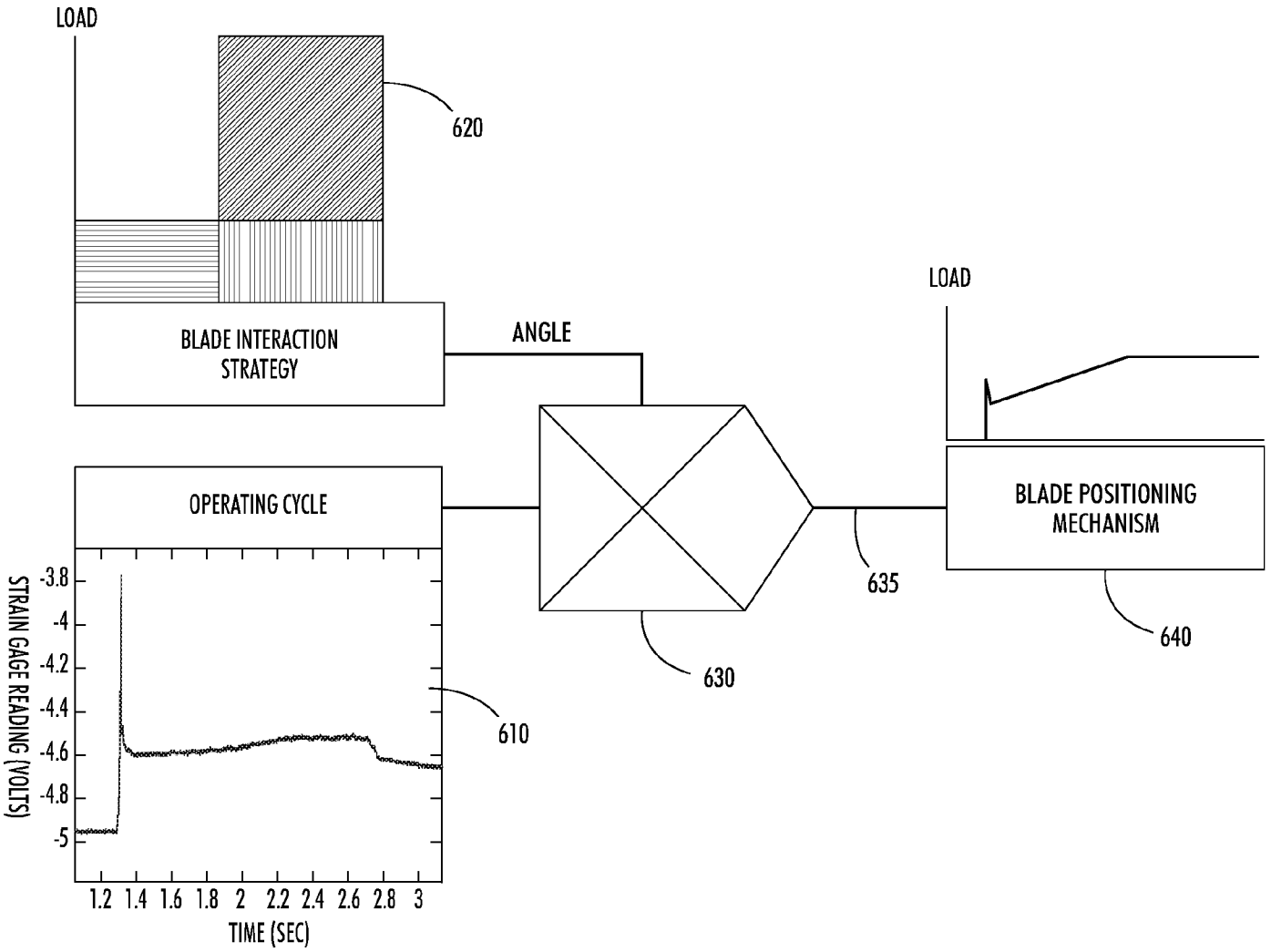
FIG. 6 is a block diagram of a blade engagement apparatus to increase the life of a blade related to an image forming machine having an associated moving surface in accordance to an embodiment.

FIG. 6 is a block diagram of a blade engagement apparatus to increase the life of a blade related to an image forming machine having an associated moving surface in accordance to an embodiment. The operating cycle 610 is segmented into three distinct sub-cycles, namely start-operate-shut-down procedure. Such segmentation can be accomplished by monitoring machine process controller signals or by monitoring encoder roll signals (not shown). The blade integration strategy 620 is selected from the group comprising low blade load, an operating speed blade load, and a standby blade load as explained above with reference to FIG. 5. The operating cycle 610 and blade integration strategy 620 are employed by driver 630 to generate a signal 635 that will cause a blade positioning mechanism 640 to move the blade into a position wherein the blade tip engages the moving surface creating a blade load on the moving surface in accordance to the desired strategy.

Figure 7:
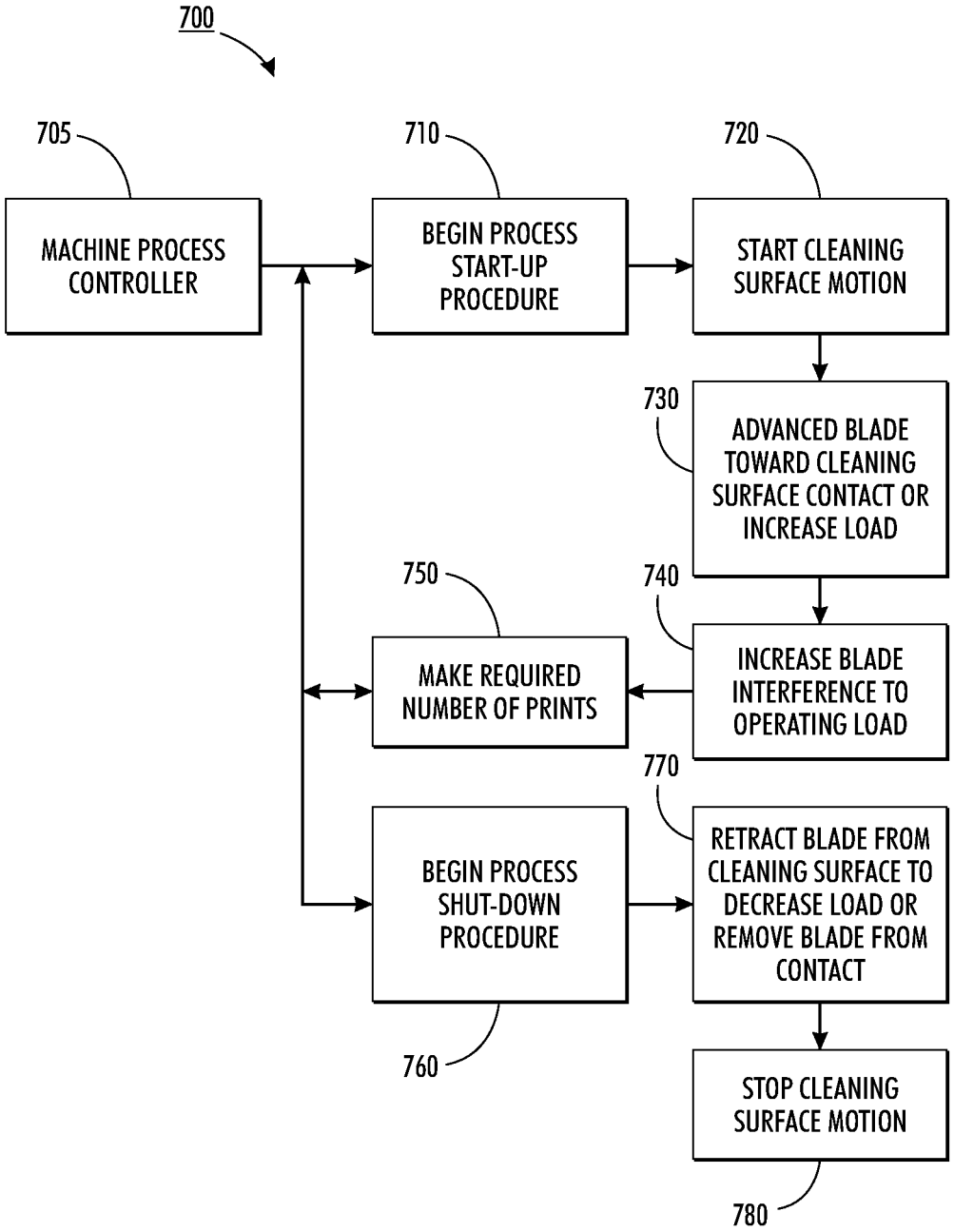
FIG. 7 is a flow chart of a method for blade load adjustment in accordance to an embodiment.

FIG. 7 is a flow chart of a method 700 for blade load adjustment in accordance to an embodiment. Method 700 causes the blade to go from low load or no contact up to full operating load as the cleaning surface begins to move. When the cleaning surface begins to slow to a stop the blade load is reduced to the standby low load or removed entirely from contact with the cleaning surface. Method 700 is not an intermittent or periodic process, but performed at every start and stop of the cleaning surface. By reducing blade load when the cleaning surface is traveling below the operating speed, high blade stresses are avoided and blade life and reliability are improved. Method 700 begins with action 705 where a machine process controller generates a series of commands for completing printing jobs in accordance to the capabilities of the image forming machine. In action 710, a begin process start-up procedure is detected from the commands issued by the process controller. In response to the begin process start-up procedure 710 a cleaning process is started in action 720. In action 720, a start cleaning surface motion is initiated by method 700. The start cleaning surface motion can be a signal sent to the blade positioning mechanism 206 to begin a process for positioning the blade against the moving surface or can be a signal sent to a cleaning surface such as a cleaning drum, photoreceptor belt, or pickup roll and the like to begin a cleaning process. Control then passes to action 730 for further processing. In action 730, a command to advance the blade 76 towards the cleaning surface or increase the load is initiated. If the blade is in a retracted position 520 then the blade is moved towards a low load 530. However, if the natural position of the blade is in the low load 530 then the load is gradually increased. After action 730 control is then passed to action 740 for further processing. In action 740, the blade positioning mechanism 206 increases blade interference to operating load. The blade is maintained at the operating load until a condition such as the desired number of prints is met. In action 750, a make required number of prints determination is made. After the required number of prints is made the machine process controller 705 generates a command that is processed by action 760. In action 760, a begin process shut-down procedure is initiated and control is passed to action 770 for further processing. In action 770, a sequence is initiated to retract the blade from the surface to decrease load or to remove the blade from contact. As noted above with reference to FIG. 5 for process shut-down blade contact proceeds from operating load 550 to low load 530 or to a retracted position 520. Method 700 ends with stop cleaning surface motion and the blade being held in place until the process begins anew.

Figure 8:
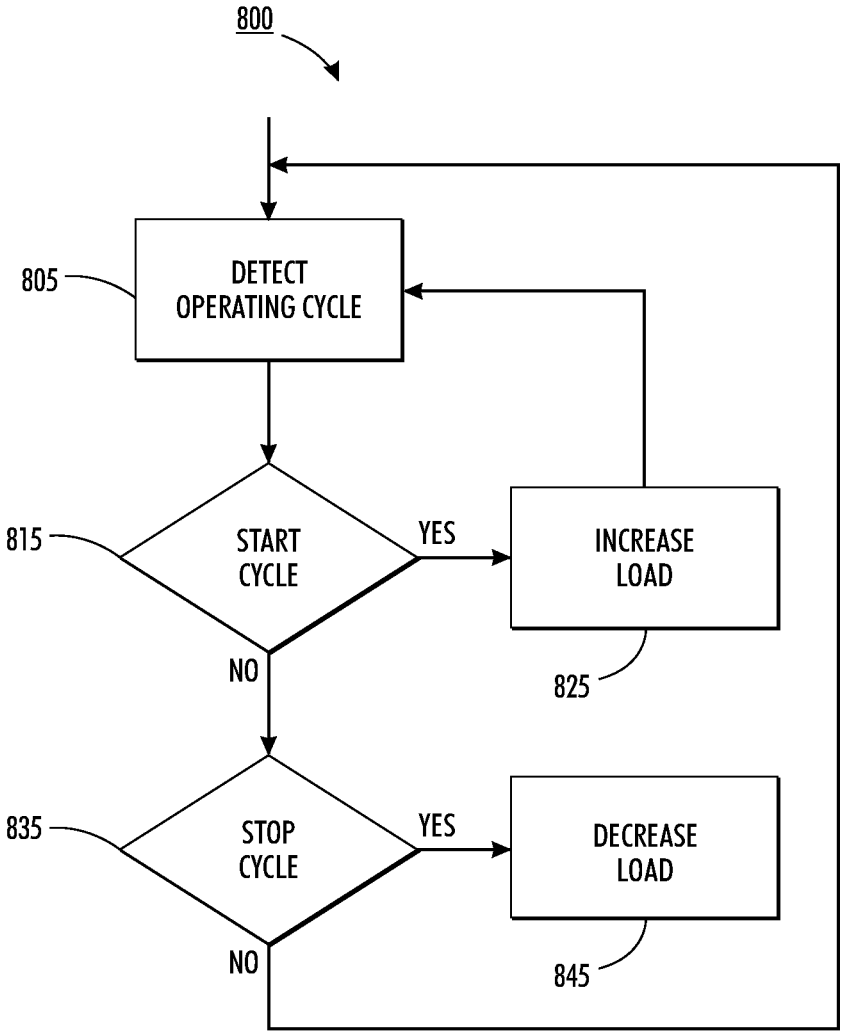
FIG. 8 is a flow chart of a method for blade wear reduction during start/stop operation in accordance to an embodiment.

FIG. 8 is a flow chart of method 800 for blade wear reduction during start/stop operation in accordance to an embodiment. Method 800 begins by detecting the operating cycle of the moving or cleaning surface. In action 805, the process detects the operating cycle to ascertain whether the surface is in an operating cycle start, an operating cycle operational speed, or in an operating cycle shut-down. The method then proceeds to action 815 to ascertain whether the operating cycle is at the start of the cycle. If the determination is "YES", action 825 then commands that the load on the blade 76 be increased in accordance to the blade interaction strategy delineated in FIG. 5. If the determination is "NO", action 835 determines if the operating cycle is in a stop cycle or shut-down procedure posture. If a shut-down or stop cycle is in effect ("YES" condition) then the load on the blade is decreased by action 845. The process is repeated until the image forming machine completes a print job or until all conditions have been satisfied.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well or any other printing system having a cleaner blade and toner. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. An image forming machine comprising:

a moving surface;

a blade having a blade tip;

a blade positioning mechanism comprising a supporting member having a rotational axis and being configured to hold the blade, the blade positioning mechanism being connected to the blade to move the blade into a position wherein the blade tip engages the moving surface creating a blade load on the moving surface, the blade load being at least one of a low blade load, an operating speed blade load, and a standby blade load;

a sensor to detect an operating cycle for the image forming machine, wherein the operating cycle comprises at least a start-up procedure and a shut-down procedure; and a controller to cause the blade positioning mechanism to advance or retract the blade based on the detected operating cycle, wherein to retract the blade comprises moving the blade into a position in which the blade tip engages the moving surface creating a low blade load;

wherein blade wear produced from blade and moving surface contact is reduced by selectively advancing or retracting the blade during the start-up procedure and the shut-down procedure.

2. The image forming machine of claim 1, wherein the moving surface is at least one of drum rotating in an operational direction, a flat surface moving in an operational direction, or a belt moving in an operational direction.

3. The image forming machine of claim 1, further comprising:

a lubricant unit to place based on the detected start-up procedure at least one lubrication stripe of lubricating material on a portion of the moving surface.

4. The image forming machine of claim 1, wherein to advance the blade is to move the blade into a position wherein the blade tip engages the moving surface creating a low blade load.

5. The image forming machine of claim 1, wherein to advance the blade is to move the blade into a position wherein the blade tip engages the moving surface creating an operating speed blade load.

6. A method to increase the life of a blade for cleaning a moving surface, the method comprising:

detecting a predetermined operating cycle for the moving surface;

increasing blade interaction with the moving surface after a start of the operating cycle, wherein the blade interaction is selected from a group consisting of a low blade load or an operating speed blade load and is performed through a blade positioning mechanism that comprises a supporting member having a rotational axis and being configured to hold the blade;

decreasing the blade interaction with the moving surface during a shut-down of the operating cycle, wherein the blade interaction is selected from a group consisting of a low blade load or a standby blade load and decreasing blade interaction comprises moving the blade into a position wherein a blade tip engages the moving surface creating a low blade load;

wherein wear produced from blade and moving surface contact is reduced by selectively increasing and decreasing blade interaction with the moving surface at the start and shut-down of the operating cycle.

7. The method according to claim 6, wherein the moving surface is selected from a group consisting of a photoreceptor roll, a photoreceptor belt, an intermediate transfer belt, a bias transfer belt, a bias transfer roll, an electrostatic detoning roll and a bias charging roll.

8. The method according to claim 6, further comprising:

placing based on the detected start of the operating cycle at least one lubrication stripe of lubricating material on a portion of the moving surface.

9. The method according to claim 6, wherein increasing blade interaction is to move the blade into a position wherein a blade tip engages the moving surface creating a low blade load.

10. The method according to claim 6, wherein increasing blade interaction is to move the blade after a detected start of the operating cycle into a position wherein a blade tip engages the moving surface creating an operating speed blade load.

11. A blade engagement apparatus to increase the life of a blade associated with an image forming machine having an associated moving surface, the apparatus comprising:

a blade having a blade tip;

a blade positioning mechanism connected to the blade to move the blade into a position wherein the blade tip engages the moving surface creating a blade load on the moving surface;

an actuator connected to the blade positioning mechanism;

a sensor coupled to the moving surface, wherein movement of the moving surface causes the sensor to generate signals; and a logic circuit to selectively adjust the position of the blade based on the generated sensor signals by:

determining from the generated signals an operating cycle start, an operating cycle operational speed, and an operating cycle shut-down procedure; and signaling the actuator to actuate the blade positioning mechanism to adjust the blade load for each operating cycle, wherein the blade load is at least one of a low blade load, an operating speed blade load, and a standby blade load.

12. The blade engagement apparatus of claim 11, wherein the moving surface is selected from a group consisting of a photoreceptor roll, a photoreceptor belt, an intermediate transfer belt, a bias transfer belt, a bias transfer roll, an electrostatic detoning roll and a bias charging roll.

13. The blade engagement apparatus of claim 11, wherein the blade positioning mechanism comprises a supporting member having a rotational axis and being configured to hold the blade.

14. The blade engagement apparatus of claim 13, further comprising:

a lubricant unit to place based on the determined operating cycle start at least one lubrication stripe of lubricating material on a portion of the moving surface.

15. The blade engagement apparatus of claim 13, wherein to adjust the blade comprises moving the blade into a position wherein the blade tip engages the moving surface creating a low blade load during the operating cycle start and the operating cycle shut-down procedure.

16. The blade engagement apparatus of claim 13, wherein to adjust the blade is to move the blade after the operating cycle start into a position wherein the blade tip engages the moving surface creating an operating speed blade load.

* * * * *